US005139158A

United States Patent [19]

Lindner et al.

[11] Patent Number: 5,139,158

[45] Date of Patent: Aug. 18, 1992

[54] COUPLING AND UNCOUPLING DEVICE FOR AN ELECTRICAL CABLE COUPLING AND A MECHANICAL MIDDLE BUFFER COUPLING FOR RAIL-BORNE VEHICLES, AS WELL AS A SWITCHING DEVICE FOR ACTUATING THE COUPLING AND UNCOUPLING DEVICE FOR COUPLING AND UNCOUPLING

[75] Inventors: Harald Lindner; Ernst Hartmann, both of Salzgitter, Fed. Rep. of Germany

[73] Assignee: ScharfenbergKupplung GmbH, Salzgitter, Fed. Rep. of Germany

[21] Appl. No.: 685,447

[22] Filed: Apr. 15, 1991

[30] Foreign Application Priority Data

Apr. 27, 1990 [DE] Fed. Rep. of Germany ..... 4013521

[51] Int. Cl.[5] ..... B61G 5/06

[52] U.S. Cl. ..... 213/1.6; 213/1.3; 439/310

[58] Field of Search ..... 213/1.3, 1.6; 280/422; 439/284, 259, 289, 292, 293, 294, 295, 296, 310

[56] References Cited

U.S. PATENT DOCUMENTS

| | | | |
|---|---|---|---|
| 3,385,454 | 5/1968 | Jeffrey et al. | 280/422 |
| 4,049,128 | 9/1977 | Jeffrey | 213/1.6 |
| 4,892,204 | 1/1990 | Lumbis | 213/1.3 X |
| 4,953,726 | 9/1990 | Loutan | 213/1.3 |

*Primary Examiner*—Robert J. Oberleitner
*Assistant Examiner*—Kevin D. Rutherford
*Attorney, Agent, or Firm*—McGlew & Tuttle

[57] ABSTRACT

To couple the initiation and the chronological sequence of a coupling or uncoupling process of a mechanical middle buffer coupling and an electrical cable coupling with a common rotary drive with the smallest amount of control effort possible in a reliable manner, a coupling and uncoupling device has a shaft, which can be driven at right angles to the coupling axis and is fastened non-rotatably on an actuating arm that extends into a guide rail of the cable coupling and is consequently designed as a direct drive member of the cable coupling, wherein an uncoupling lever for the mechanical middle buffer coupling and the actuating arm are positively coupled via the shaft. A switching device for the coupling and uncoupling device with switches and initiating members or control cams controls the initiation and the chronological sequences of the coupling and uncoupling process of the mechanical middle buffer coupling and the electrical cable coupling.

10 Claims, 3 Drawing Sheets

COUPLING AND UNCOUPLING DEVICE FOR AN ELECTRICAL CABLE COUPLING AND A MECHANICAL MIDDLE BUFFER COUPLING FOR RAIL-BORNE VEHICLES, AS WELL AS A SWITCHING DEVICE FOR ACTUATING THE COUPLING AND UNCOUPLING DEVICE FOR COUPLING AND UNCOUPLING

FIELD OF THE INVENTION

The present invention pertains to a coupling and uncoupling device for an electrical cable coupling, and a mechanical middle or intermediate buffer coupling for rail-borne vehicles wherein the coupling and uncoupling device can be driven by means of a rotary drive for moving, via a gear mechanism, the electrical cable coupling alternatingly into the coupled front end position or the uncoupled rear end position, the arrangement also actuating the release member of the middle buffer coupling, the cable coupling being arranged on the middle buffer coupling longitudinally displacably in the direction of the coupling axis, the gear mechanism being provided with a shaft arranged at right angles to the coupling axis such that the shaft engages with a guide rail of the cable coupling arranged at right angles to the coupling axis providing a direct drive member of the cable coupling and consequently a kinematic chain in the form of a reciprocating Scotch yoke, as well as to a switching device for coupling and uncoupling the electrical cable coupling and the mechanical middle buffer coupling.

BACKGROUND OF THE INVENTION

A gear mechanism consisting of a four-bar linkage forming a Scotch yoke performing reciprocating movement is generally known from the manuscript *Getriebelehre I* [Kinematics I] by Prof. Dr. B. Dizioglu, TU Braunschweig, 1974, p. 9. A drive arm that is able to rotate around a fixed bearing acts with its other end on a sliding block, this outer end is held linearly displacably in a guideway of a guide rail. A sliding bar, which is directed at right angles to the guideway and is guided in a fixed bearing, is fastened to the guide rail. Due to this arrangement, transformation of a rotary movement of the drive arm into a longitudinal movement of the guide rail at right angles to its guideway and to the sliding bar fastened to it is achieved. Thus, the guide rail and the sliding bar are arranged in a cross-shaped pattern. During clockwise rotation of the drive arm out of a position that is parallel to the sliding bar through 180°, each point of the sliding bar moves in the axial direction of the sliding bar from a front end position to a rear end position. During further rotation in the same direction, each point of the sliding bar will again move from the rear end position to the front end position, i.e., each point of the sliding bar returns from the front end position into the front end position via the rear end position during each full revolution of the drive arm. Each point of the sliding bar again moves from the rear end position to the front end position during rotation in the opposite direction as well.

The above-mentioned, well-known principle of the Scotch yoke performing reciprocating movement is applied in EP-0,339,348 A1 to the actuating mechanism of an electrical cable coupling for rail-borne vehicles. The manner of coupling and the electrical cable coupling require a separate actuation of the electrical cable coupling and of the release mechanism for the mechanical coupling for each switching cycle, so that when operating the rotary drive of the electrical cable coupling, the operator must decide on and initiate connection, i.e., coupling with the release mechanism, separately in each switching cycle if actuation of the release mechanism is necessary. A suitable switching device or process control for actuating the coupling device, especially in cooperation with a counter-coupling, is not specified.

SUMMARY AND OBJECTS OF THE INVENTION

It is a primary object of the present invention to design a coupling and uncoupling device of the above mentioned type for an electrical cable coupling and a mechanical middle buffer coupling for rail-borne vehicles in a compact design such that the initiation and the time sequence of the coupling and uncoupling process of the mechanical middle buffer coupling and of the electrical cable coupling are coupled or directly related to each other by using a common drive for actuation, in a reliably operating manner, with the smallest possible amount of control effort, especially manual control effort, as well as to design a switching device for actuating the coupling and uncoupling device.

According to the invention, a coupling and uncoupling device is provided for an electrical cable coupling and a mechanical middle buffer for rail-borne vehicles. The arrangement comprises an electrical cable coupling arrangement including a guide rail along which the electrical cable coupling is moveable between a coupled front end position and an uncoupled rear end position. A rotary drive arrangement is provided including a gear mechanism with a shaft arranged at right angles to the coupling axis. The shaft includes an arm engaging the cable coupling at right angles to the coupling axis for acting as a direct drive member for moving the cable coupling along the guide rail and providing a kinematic chain in the form of a reciprocating Scotch yoke arrangement, which is well known from kinematics. A mechanical middle buffer arrangement is provided including the mechanical buffer coupling including a mechanical lock with a release member having a switching zone. An uncoupling lever with a release cam is nonrotatably connected to the shaft such that the release cam can be rotated into the switching zone of the release member for releasing the mechanical lock.

The uncoupling lever and the actuating arm are positively coupled by the shaft such that the release cam actuates the release member of the lock chronologically after the beginning of the displacement of the cable coupling into the rear end position. After completion of the locking process or in close chronological connection with the locking process at the mechanical middle buffer coupling, the actuating arm displaces the cable coupling into the front end position, the shaft can be rotated from the coupled position of the cable coupling (from the front end position, into the uncoupled position of the cable coupling—into the rear end position) by rotation either to the left or to the right (counter clockwise or clockwise) via the rotary drive which can be switched in both directions of rotation. A switching device is provided controlling the actuation of the coupling and uncoupling device.

According to a further aspect of the invention the switching device includes a switch which is arranged in the switching zone of the releasing member of a counter coupling (the counter coupling including essentially the same arrangement as noted above and being positioned opposite the above referenced coupling and uncoupling device). The switch is actuated upon completion of or in close chronological relationship with the locking process and initiates turning on of the rotary drive to displace the cable coupling into the front end position. The switching device includes a control switch for directly initiating an uncoupling process and a contact device of the cable coupling for directly initiating an uncoupled process. The contact device makes it possible to send an uncoupling signal to the cable coupling of the counter coupling (coupling of other vehicle) or to receive such a signal from the cable coupling of the counter coupling. The switching device includes at least one control cam which is non-rotatably connected to the shaft rotated by the rotary drive. The switching device has at least one switch which is arranged in the range of rotation of the control cam and can be actuated by the control cam. The control cam thereby actuates the switch and initiates switching off of the cable coupling as soon as the cable coupling is moved into the rear end position. The control cam actuates the switch and initiates the switching off of the rotary drive as soon as the cable coupling of the counter coupling is moved into the front end position.

Due to the design of the coupling and uncoupling device and the switching device according to the present invention, the initiation of and the movement processes associated with the actuation of the electrical cable coupling and the mechanical middle buffer coupling are inherently coupled via the shaft, using a common rotary drive, in a reliably operating manner and with a small amount of control effort, especially manual control effort. The switching device and the process control are designed such that the operator has to generate an uncoupling signal for connecting the rotary drive only when the uncoupling signal is generated on the side of two coupled middle buffer couplings which side initiates the uncoupling process. Both the uncoupling process on the side of the counter-coupling and the coupling process in a coupling pair are able to take place automatically or can be initiated with the coupling and uncoupling device without any additional intervention on the part of the operator, via the switching device.

A further object of the invention is to provide a controlled coupling arrangement which is simple in design, rugged in construction and economical to manufacture.

The various features of novelty which characterize the invention are pointed out with particularity in the claims annexed to and forming a part of this disclosure. For a better understanding of the invention, its operating advantages and specific objects obtained by its uses, reference is made to the accompanying drawings and descriptive matter in which a preferred embodiment of the invention is illustrated.

DETAILED DESCRIPTION OF THE PREFERRED EMBODIMENT

Figure 1:
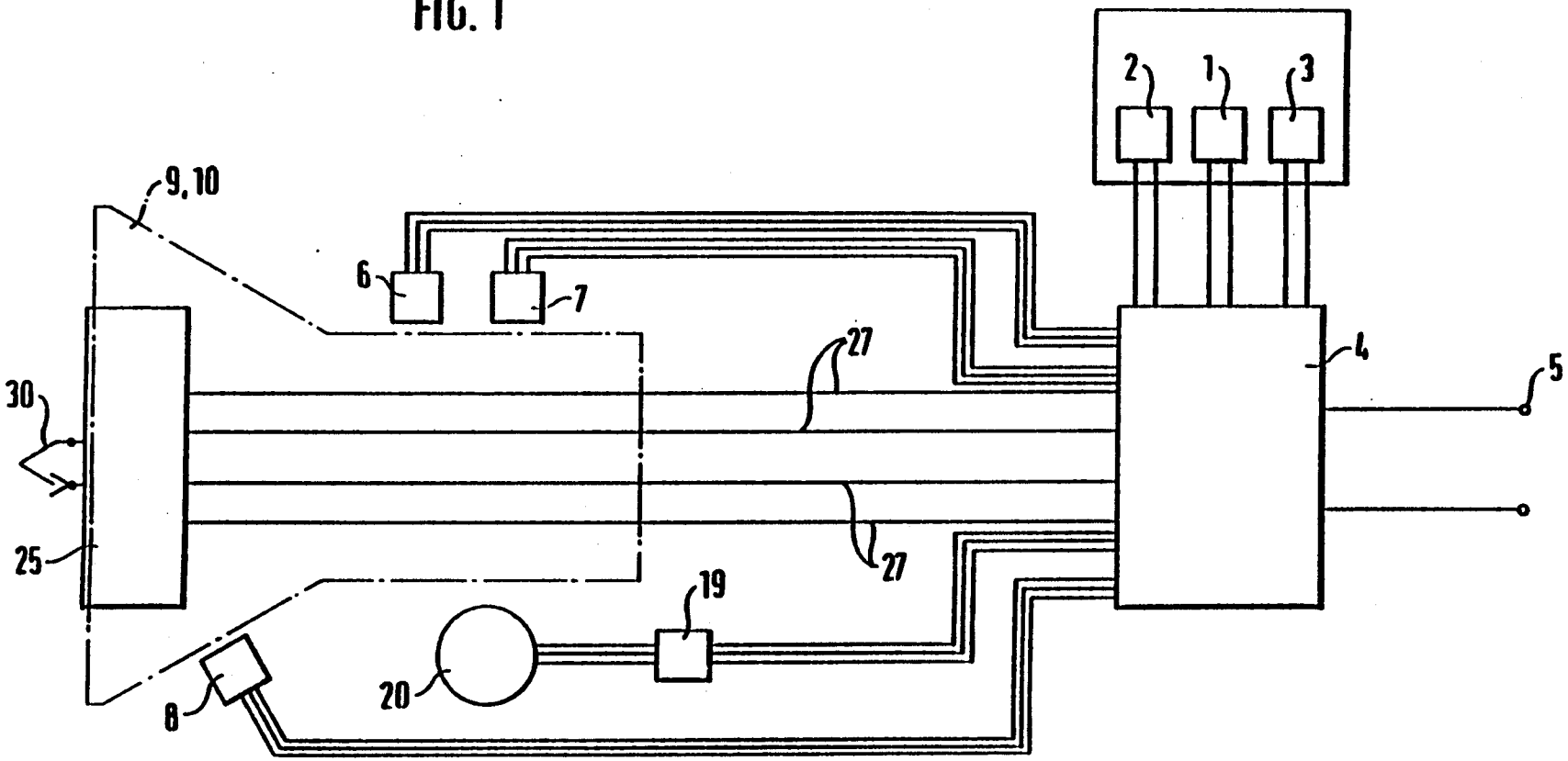
FIG. 1 is a schematic representation of a switching device for actuating a coupling and uncoupling device.
Figure 2:
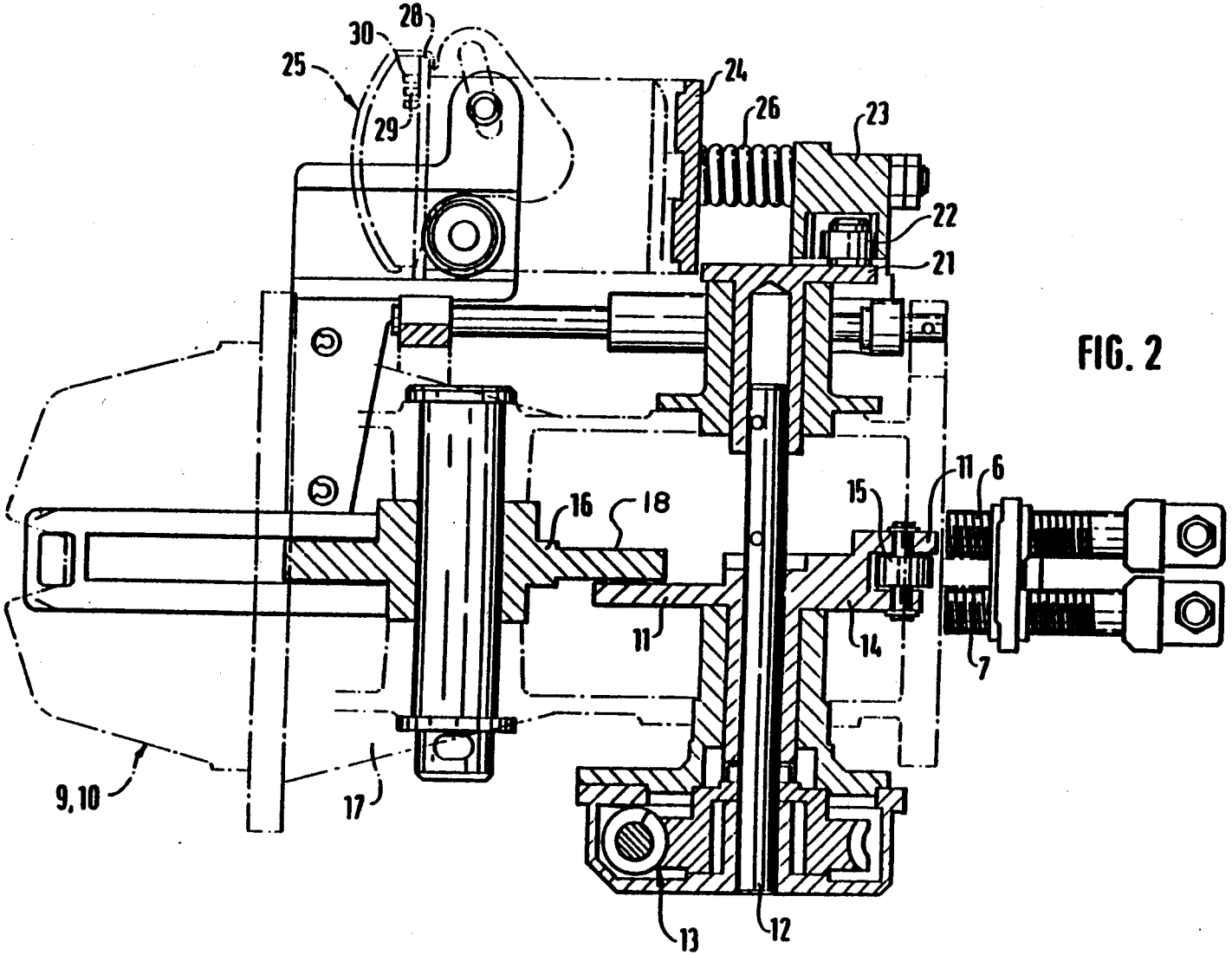
FIG. 2 is a partially cut-away side view of a coupling and uncoupling device according to the present invention.
Figures 3A, 3B, 3C, 3D:
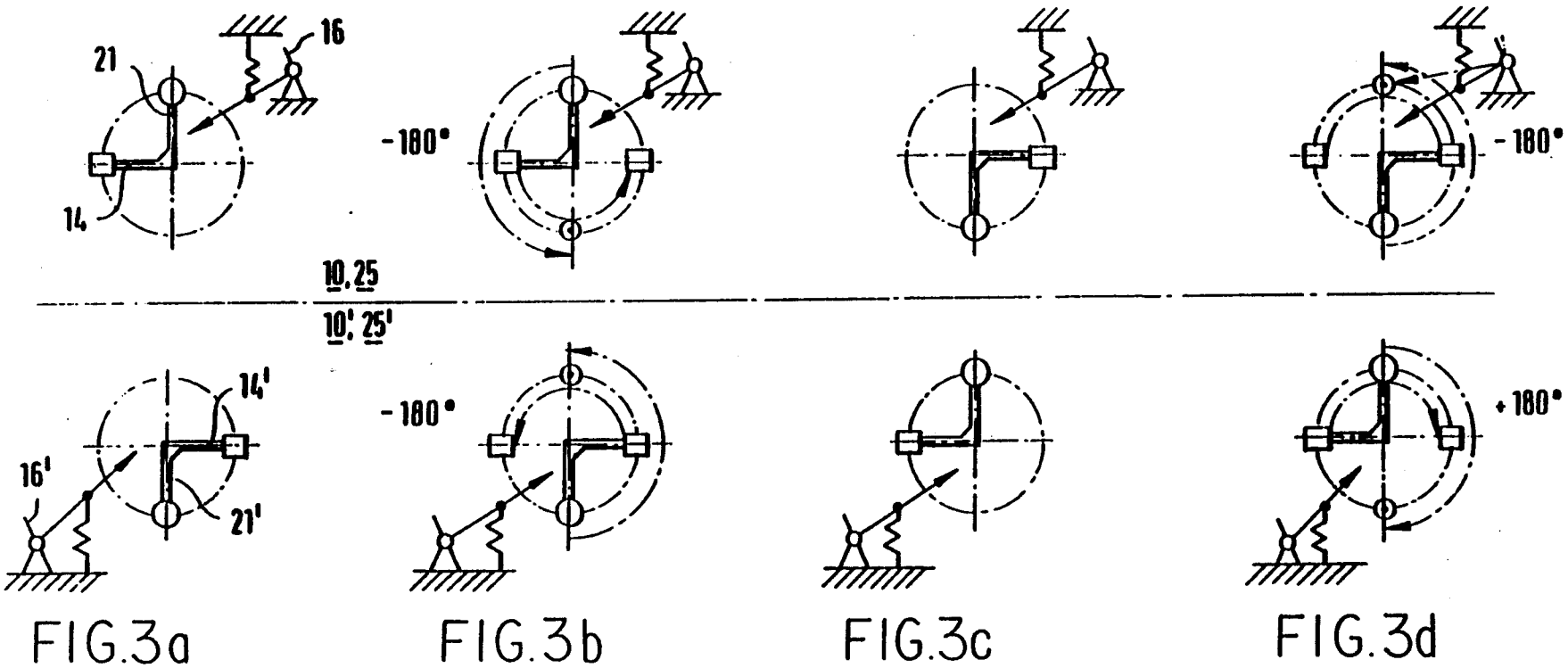
FIGS. 3*a*–3*d* are a representation of the movement processes and positions of the actuating arm and the uncoupling lever during and after the coupling and uncoupling process.

A switching device or process control according to FIG. 1 for a coupling and uncoupling device according to FIG. 2 has, in the control stand, a control switch 1, a signal display unit 2 for the "coupling ready to couple" signal and a signal display unit 3 for the "coupling mechanically and electrically coupled" signal, wherein the control switch 1 and the signal display units 2 and 3 are connected to the control device 4 via electrical lines. The control device 4 is supplied by a power source 5. From the control device 4, electrical lines lead to the switches 6, 7 and 8, especially to inductive proximity switches, which are arranged in the coupling head 9 of a mechanical middle buffer coupling 10.

The proximity switches 6 and 7 are arranged in the range of rotation of a control cam 11, which is non-rotatably connected to a shaft 12 of a gear mechanism 13. An uncoupling lever 14 with a release cam 15 arranged on it for releasing the lock 16 of the mechanical middle buffer coupling 10 is also arranged non-rotatably on the shaft 12. The control cam 11 may be arranged on the uncoupling lever 14. The proximity switch 8 is arranged in the zone of a catching tong 17 of the middle buffer coupling 10 for a releasing member 18' of the counter-coupling 10', which releasing member is to be introduced into the catching tong 17. Furthermore, electrical lines are led from the control device 4 via a double-throw switch 19 to a rotary drive 20, especially an electric motor, which can be switched in both directions of rotation.

The electric motor 20 is coupled with the shaft 12 via the gear mechanism 13 and it drives the shaft 12. An actuating arm 21, whose other end carries a guide member 22, is non-rotatably arranged on the shaft 12. The guide member 22 extends into a guide rail 23 arranged at right angles to the coupling axis, on which guide rail 23 a support block 24 carrying an electrical cable coupling 25 is arranged on the side pointing toward the coupling plane. The cable coupling 25 is arranged and guided longitudinally displacably in the direction of the coupling axis on the middle buffer coupling 10. In the exemplified embodiment, the cable coupling 25 is arranged and guided at the top on the middle buffer coupling 10. A spring 26 acting in the direction of the coupling axis is arranged between the support block 24 and the cable coupling 25 to generate and reliably maintain the necessary contact pressure of the cable coupling 25 in the coupled state.

Thus, via the actuating arm 21, the actuation of the electrical cable coupling 25 is automatically coupled by the shaft 12 with the actuation of the lock 16 via the uncoupling lever 14 of the mechanical middle buffer coupling 10. For reasons of graphic representation, the actuating arm 21 is arranged rotated through 90° relative to the uncoupling lever 14 on the common axis of rotation in FIGS. 3*a*–3*d*. The necessity and the amount of an angular displacement depends on the position of a release member of the mechanical lock 16 in the range of rotation of the release cam 15 of the uncoupling lever 14.

Contact lines, which are also to be coupled during the coupling process, are led from the control device 4 to the electrical cable coupling 25. The contact lines end in a contact insert 28 with the contacts 29 of the cable coupling 25. To transmit an uncoupling command to the counter-coupling 10', a contact device 30 is provided on the cable coupling 25.

A coupling and uncoupling process of the electrical cable coupling and of the mechanical middle buffer coupling 10 will be described below with reference especially to FIG. 3a-3d. It is assumed that the middle buffer coupling 10 and the cable coupling 25 cooperate with an identical counter-coupling 10' and an identical cable coupling 26', respectively. Identical characteristics are designated by identical reference numerals with primes.

To initiate an uncoupling process, the electric motor 20 is turned on via the control switch 1 and the control device 4 via the double-throw switch 19. Via the gear mechanism 13, the electric motor 20 turns the shaft 12 and the actuating arm 21, which is connected to it non-rotatably; a specified angle of rotation of 180° between the two end positions is particularly favorable, because it is thus possible to reach the end position which the actuating arm 21 is to reach by either a single rotation to the left or by a single rotation to the right, while the angle of rotation remains the same. Via the guide member 22 and the guide rail 23, the cable coupling is now displaced longitudinally from the front end position from the coupling plane in the direction of its articulation. After the cable coupling 25 has been displaced at least by a preselectable distance, which is determined by the reliable separation of the electrical contacts 29 of the cable coupling 25, the uncoupling lever 14, which is rotated with the shaft 12 and in the same direction and is arranged behind the actuating arm 21, will release, with the release cam 15 arranged on it, the release member of the lock 16 of the mechanical middle buffer coupling 10. The necessity and the amount of an angular displacement between the actuating arm 21 and the uncoupling lever 14 depend on the position of a release member of the lock 16 in the range of rotation of the release cam 15. It is essential for the function that the release cam 15 shall actuate the release member of the lock 16 after the cable coupling 25 has been displaced at least by a distance that is determined by the reliable separation of the electrical contacts of the cable coupling 25. When the predetermined angle of rotation has been reached—after 180° in the embodiment—the control cam 11 connected non-rotatably to the shaft 12 enters into the zone of switching of the proximity switch 7 and generates a switching impulse. The switching impulse is sent to the control device 4 and causes the electric motor 20 to be turned off. The cable coupling 25 is located in its rear end position. The uncoupling process is thus complete at the middle buffer coupling 10 that induces the uncoupling. The control device 4 sends a signal to the signal display unit 2, which displays the correct uncoupling process. On the side of the counter-coupling 10', the uncoupling process for the counter-coupling 10' is initiated by the uncoupling process of the cable coupling 25 via the contact device 30.

The contact device 30' of the cable coupling 25' of the counter-coupling 10' sends a switching impulse to the electric motor 20' of the counter-coupling 10' via the control device 4' and the double-throw switch 19'. The poles of the electric motor 20' are now reversed, and the motor rotates opposite the direction of rotation of the electric motor 20 of the middle buffer coupling 10 inducing the uncoupling process. The electric motor 20' of the counter-coupling 10' acts via the gear mechanism 13' on the actuating arm 21' arranged on the shaft 12', which actuating arm 21' is coupled with the electrical cable coupling 25'. The direction of rotation of the shaft 12' is opposite the direction of rotation of the shaft 12 of the middle buffer coupling 10. With its guide member 22', the actuating arm 21' extends into the guide rail 23' and displaces the cable coupling 25' into the specified rear end position during rotation around the axis of the shaft 12'. The uncoupling lever 14', which is rotated simultaneously with the shaft 12', rotates in this direction of rotation without the release cam 15' extending into the release member of the lock 16' of the mechanical counter-coupling 10' for release. When the specified angle of rotation has been reached, the control cam 11' connected non-rotatably to the shaft 12' reaches the zone of switching of the proximity switch 7' and generates a switching impulse for turning off the electric motor 20', as in the case of the inducing middle buffer coupling 10. The cable coupling 25' is moved to the rear end position, and the uncoupling process of the counter-coupling 10' is correctly terminated, which is displayed on the signal display unit 2'.

During the coupling of an automatic middle buffer coupling 10 with a counter-coupling 10', the respective mechanical locks 16 and 16' of the couplings come together and automatically reach the locked position. Upon completion of the locking process or in a close chronological connection with the locking process, the releasing member 18' of the counter-coupling 10' induces the proximity switch 8 of the middle buffer coupling 10, and a release member 18 of the middle buffer coupling 10 induces the proximity switch 8' of the counter-coupling 10'.

The processes taking place to couple the electrical cable couplings 25 and 25' are the same on both coupling sides, so that only explanations for one coupling side, e.g., for the side of the middle buffer coupling 10, are needed to describe the coupling process.

The proximity switch 8 initiates the turning on of the electric motor 20 via the control device 4 and the double-throw switch 19. The direction of rotation of the electric motor 20 is the same as the direction of rotation during the uncoupling process on the side of the initiating middle buffer coupling 10. Via the gear mechanism 13, the electric motor 20 acts on the actuating arm arranged on the shaft 12, which is coupled with the electrical cable coupling 25. Due to the direction of rotation of the electric motor 20, the direction of rotation of the shaft 12 is the same as the direction of rotation of the shaft 12 during the uncoupling process on the initiating side. With its guide member 22, the actuating arm 21 extends into the guide rail 23, and displaces the cable coupling 25 from the rear end position into the intended front end position during rotation around the axis of the shaft 12. The uncoupling lever 14, which is rotated simultaneously with the shaft 12, rotates in this sense of rotation without the release cam 15 extending into and releasing the lock 16 of the middle buffer coupling 10. After the specified angle of rotation has been reached, the control cam 11 connected to the shaft 12 reaches the zone of switching of the proximity switch 6. The proximity switch 6 initiates the switching off of the electric motor 20 via the control device 4. The cable coupling 25 is moved into the front end position, and the correct coupling process is displayed on the signal display unit 3. In principle, it is also possible to provide the coupling and uncoupling device according to the present invention as well as the switching device for actuating more than one cable coupling 25, e.g., two cable couplings 25 arranged on the side above and under the middle buffer coupling 10 by means of a branched gear mechanism arranged between the uncoupling lever 14 and the actuating arms 21.

While a specific embodiment of the invention has been shown and described in detail to illustrate the application of the principles of the invention, it will be understood that the invention may be embodied otherwise without departing from such principles.

What is claimed is:

1. A coupling and uncoupling device for an electrical cable coupling and a mechanical middle buffer coupling for rail-borne vehicles, comprising: electrical cable coupling arrangement including a guide rail along which the electrical cable coupling is moveable between a coupled front end position and an uncoupled rear end position along a coupling axis; a mechanical middle buffer arrangement including a mechanical block with a release member having a switching zone; a gear mechanism having a shaft arranged at right angles to the coupling axis; a rotary drive connected to said gear mechanism for driving said gear mechanism; an actuating arm positively connected to said shaft and engaged with said electrical cable coupling for providing a direct drive of said cable coupling; an uncoupling lever with a release cam nonrotatably connected to said shaft, said release cam being positioned for rotation into the switching zone of said release member for releasing the mechanical lock, said uncoupling lever and said actuating arm being positively coupled by said shaft, said release cam for actuating the release member of the lock chronologically after the beginning of the displacement of the cable coupling into the rear end position and for displacing the cable coupling into the front end position at least in a close chronological connection with the locking process of the mechanical middle buffer, said shaft being rotatable from a coupled position of the cabled coupling and into an uncoupled position of the cable coupling by rotation in either a clockwise or a counter clockwise direction; and switching control means for controlling the actuation of the coupling and the uncoupling device.

2. A coupling and uncoupling device according to claim 1, wherein said release cam maintains said release member for releasing the mechanical lock, in a non-actuated state during rotation from an angular position the release cam assumes in the front end position of the cable coupling into an angular position which the release cam assumes in the rear end position of the cable coupling.

3. A coupling and uncoupling device according to claim 1, wherein at least one control cam, which can be rotated in a switching zone of a switch for turning off the rotary drive, is connected nonrotatably to said shaft.

4. A coupling and uncoupling device according to claim 1, wherein the angle of rotation of the actuating arm in one switching cycle is set at 180°.

5. A coupling and uncoupling device according to claim 1, wherein a branching gear mechanism, for actuating more than one cable coupling, is arranged between the uncoupling lever and the actuating arm.

6. A device according to claim 1, wherein a counter coupling electrical coupling and counter coupling mechanical middle buffer coupling is provided including a releasing member, a switching device positioned in a switching zone of the counter coupling releasing member, said switching device being actuated subsequent to completion of said locking process for initiating turning on said rotary drive to displace the cable coupling into the front end position; said switching device including a control switch for directly initiating an uncoupling process and a contact device connected to the cable coupling for directly initiating an uncoupling process, said contact device providing contact for sending an uncoupling signal to a cable coupling of the counter coupling or for receiving an uncoupling signal from the cable coupling of the counter coupling, said switching device including at least one control cam, said at least one control cam being nonrotatably connected to said shaft, said switching device including at least one switch arranged in a path of rotation of said control cam and being actuated by contact with said control cam, said control cam actuating said at least one switch for initiating switching off of the cable coupling as soon as the cable coupling is moved into the rear end position and said control cam actuating said at least one switch for initiating the switching off of the rotary drive as soon as the counter-coupling is moved into the front end position.

7. A switching device according to claim 6, wherein each of said switches are designed as electrical proximity switches.

8. A switching device according to claim 6, wherein the angle of rotation of the control cam in one switching cycle is set at 180°.

9. A switching device for actuating a coupling and uncoupling device for rail-borne vehicles comprising an electrical cable coupling arrangement including an electrical cable coupling positioned on a guide rail for movement between a coupled front end position and an uncoupled rear end position along a coupling axis; a mechanical middle buffer coupling including a mechanical lock with a release member having a switching zone, said mechanical middle buffer counter coupling with a substantially identical mechanical middle buffer coupling and said electrical cable coupling with a substantially identical electrical cable counter coupling; a shaft arranged substantially at right angles to the coupling axis; an actuating arm fixedly connected to said shaft and connected to said electrical cable coupling for moving said cable coupling along said coupling axis; drive means for driving said shaft in rotation; an uncoupling lever having a release cam non-rotatably connected to said shaft, said release cam being rotatable into the switching zone of said release member for releasing said mechanical lock, said release cam actuating said release member subsequent to the beginning of displacement of said electrical cable coupling into the rear end position and after completion of a locking process, the actuating member displacing the cable coupling into the front end position; a switching device including a first switch arranged in the switching zone in the releasing member of the counter coupling actuated subsequent to completion of the locking process and initiating the turning on of the rotary drive to displace the cable coupling into the front end position, said switching device including a control switch for directly initiating an uncoupling process and a contact device associated with the cable coupling for directly initiating an uncoupling process wherein said contact device sends an uncoupling signal to the cable coupling of a counter coupling or receives an uncoupling signal from the coupling of the counter coupling, said switching device including at least one control cam which is nonrotatably connected to said shaft and a second switch and a third switch arranged on a range of rotation of said control cam, said first switch being actuated for initiating a switching off of the cable coupling as soon as the cable coupling is moved into the rear end position and said third switch being actuated for initiating the switching off of the rotary drive as soon as the counter coupling is moved into the front end position.

10. A switching device according to claim 9, wherein each of said first switch, said second switch and said third switch are designed as electrical proximity switches.

* * * * *